US005671870A

United States Patent [19]

Megargle et al.

[11] Patent Number: 5,671,870

[45] Date of Patent: Sep. 30, 1997

[54] RETURNABLE DRY PRODUCT CONTAINER

[75] Inventors: William Francis Megargle, Beverly; Wayne Michael Bruhn, Sewell, both of N.J.; Steven Lee Clements, Dunlap, Ill.

[73] Assignee: FMC Corporation, Chicago, Ill.

[21] Appl. No.: 715,511

[22] Filed: Sep. 18, 1996

Related U.S. Application Data

[62] Division of Ser. No. 359,179, Dec. 19, 1994, Pat. No. 5,598,953.

[51] Int. Cl.[6] ..... B67D 5/06

[52] U.S. Cl. ..... 222/1; 222/143; 222/181.2; 222/185.1

[58] Field of Search ..... 222/1, 143, 185.1, 222/180, 181.1, 181.2, 465.1, 466

[56] References Cited

U.S. PATENT DOCUMENTS

| | | | |
|---|---|---|---|
| 3,123,107 | 3/1964 | Kappler | 222/185.1 X |
| 3,131,832 | 5/1964 | Strandberg et al. | 222/185.1 X |
| 3,199,735 | 8/1965 | Doerpinghaus | 222/181.2 X |
| 3,318,473 | 5/1967 | Jones et al. | 222/185.1 X |
| 3,374,929 | 3/1968 | Silfverskiold | 222/181.2 X |
| 3,407,971 | 10/1968 | Oehler | 222/185.1 |
| 3,433,400 | 3/1969 | Hawkins | 222/185.1 X |
| 3,602,400 | 8/1971 | Cooke | 222/185.1 X |
| 3,729,121 | 4/1973 | Cannon | 222/185.1 |
| 3,998,362 | 12/1976 | Lapierre et al. | 222/185.1 |
| 4,398,653 | 8/1983 | Daloisio | 222/185.1 X |
| 4,423,831 | 1/1984 | Sipley | 222/185.1 X |
| 4,660,733 | 4/1987 | Snyder et al. | 222/185.1 X |
| 4,746,034 | 5/1988 | Ata et al. | 222/143 |
| 5,375,741 | 12/1994 | Harris | 222/143 X |
| 5,445,289 | 8/1995 | Owen | 222/185.1 X |

*Primary Examiner*—Kevin P. Shaver

*Attorney, Agent, or Firm*—Michael B. K. Lee; Douglas W. Rudy

[57] ABSTRACT

The invention provides a container for holding dry products. The container is a container portion mounted to a base. The container portion has sloping sides with a slope greater than the angle of repose of the dry product. The container and base form a box shape that allows maximum packing and stacking of containers. The invention minimizes hazardous waste and dust produced by conventional paper sacks used for storing pesticides.

1 Claim, 3 Drawing Sheets

RETURNABLE DRY PRODUCT CONTAINER

This application is a divisional of application Ser. No. 08/359,179, filed Dec. 19, 1994, now U.S. Pat. No. 5,598,953.

BACKGROUND OF THE INVENTION

In the prior art, dry products such as granular pesticides were stored and delivered in paper packages. These paper packages were cut open to allow the transfer of the dry product into other containers such as backpacks for dispensing the dry product. Transferring dry product from a package to a smaller backpack, created dust from the dry product. The paper packages were then disposed of with some of the dry product residue remaining in the paper packages. For packages containing granular pesticides, the dust created from filling the backpacks provides a hazard, and the disposal of paper packages with pesticide residue also provides a hazard.

SUMMARY OF THE INVENTION

The present invention provides a returnable dry product container. Such a container allows the filling of a backpack with the production of minimal dust. In addition, such a returnable container diminishes disposed waste containing residue.

DESCRIPTION OF THE PREFERRED EMBODIMENT

Figure 1:
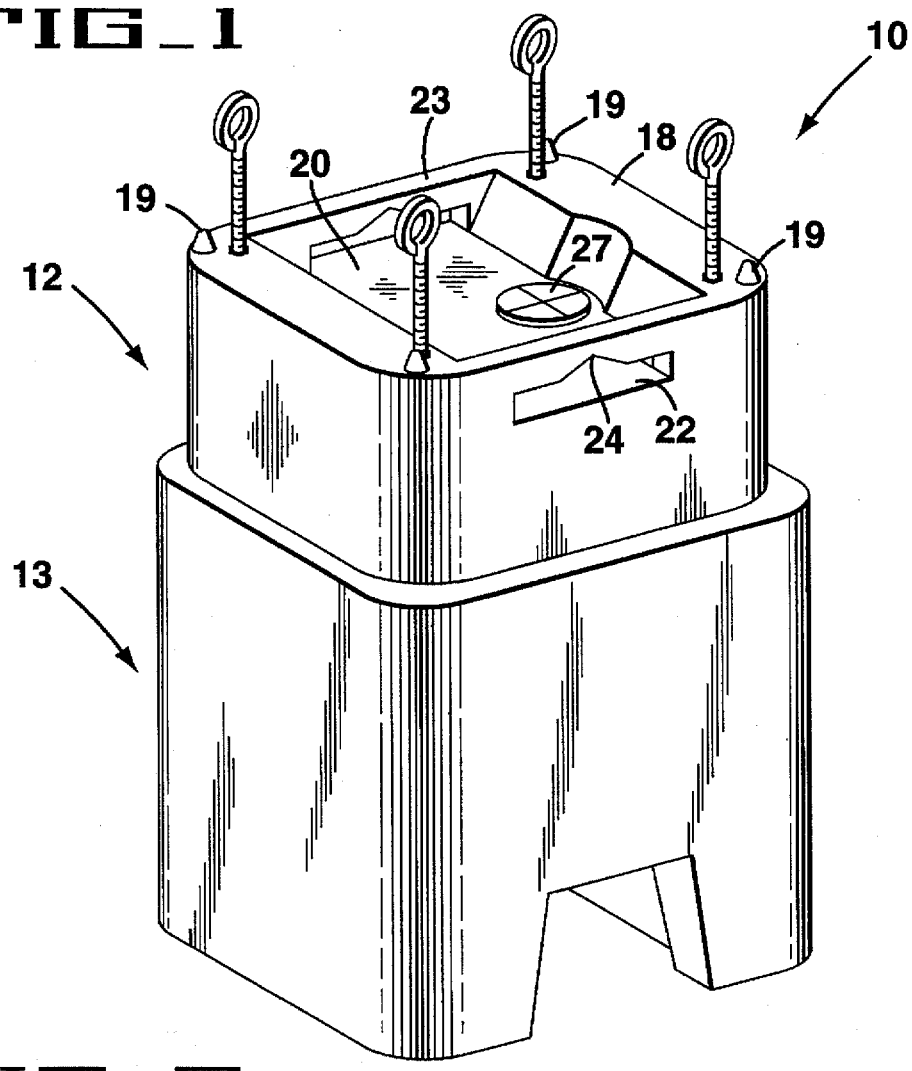
FIG. 1 is a perspective view of an embodiment of the inventive returnable dry product container.
Figure 3:
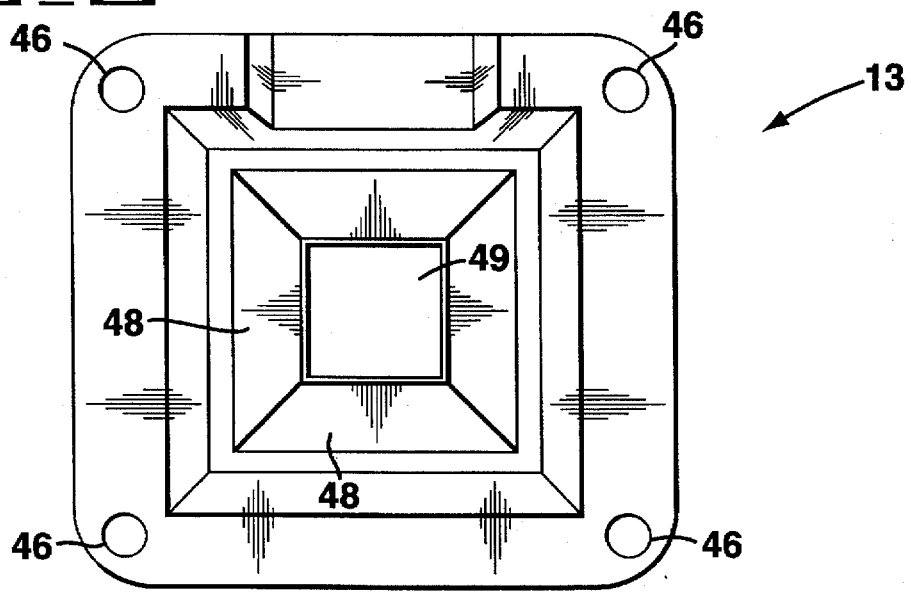
Figure 2:
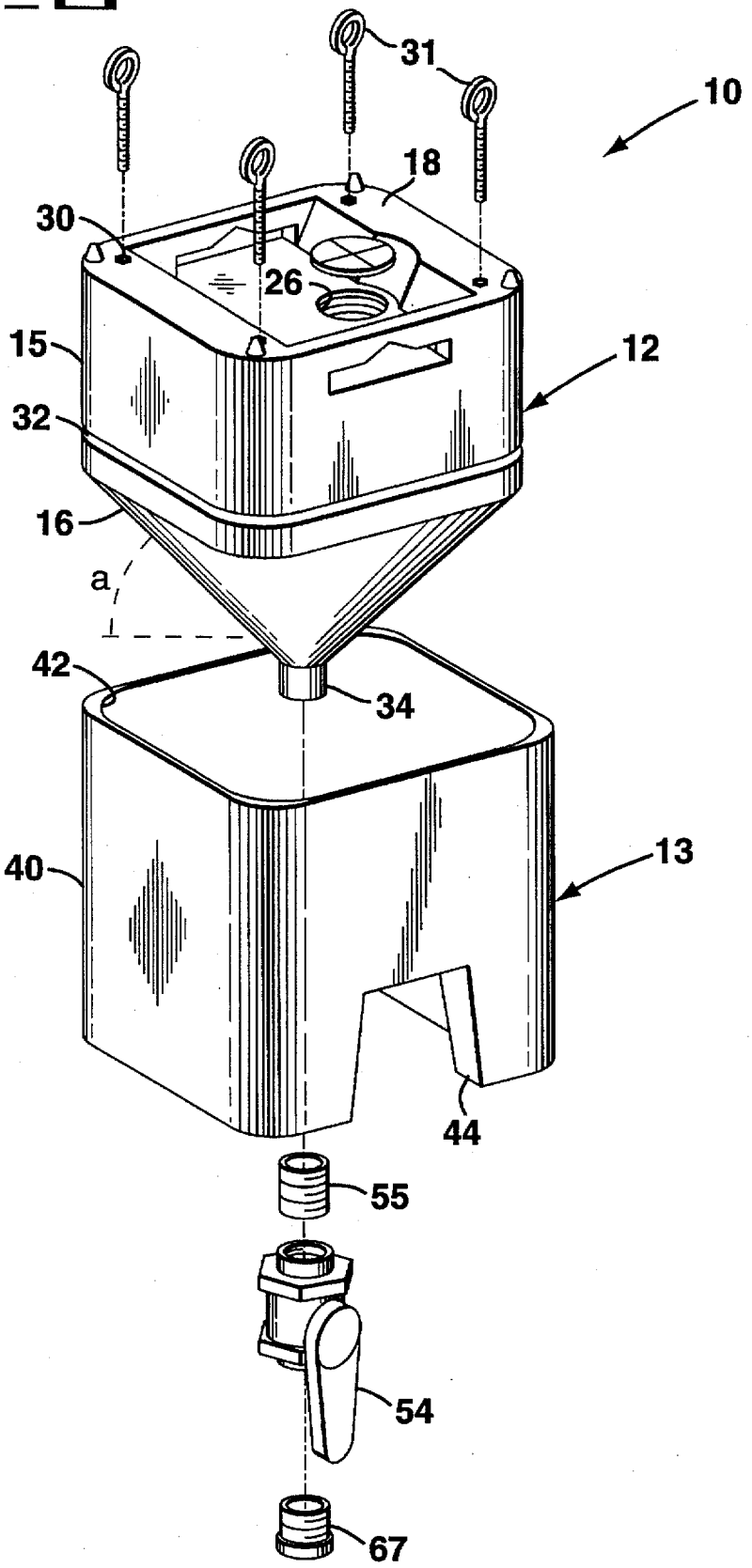
FIG. 2 is an exploded view of the returnable container in FIG. 1.

In the returnable dry product container 10 illustrated in FIGS. 1 and 2, there is a container 12 and base 13.

The container 12 is a rotationally molded, polyethylene unit which has a top portion 15 and a bottom portion 16. The top portion 15 of the container 12, has box shape with rounded corners. The bottom portion 16 of the container is cone shaped having sloping sides which are straight or at a compound angle that exceeds the angle of repose of the dry product being packed. An angle of repose for a dry product such as a pesticide may be 45°. Thus the angle a would then be greater than 45°. A preferred angle is 49°.

The top of the top portion 15 would have a flat surface 18 around the periphery of the top of the top portion 15. Four molded-in pins 19 extend from the flat surface 18. Inside the periphery of the top of the top portion 15 is an indentation 20. Slots 22 extend from the sides to the container 12 to the indentation 20 forming handles 23. Each handle has a notch 24. A threaded opening 26 is formed in the indentation 20. A threaded cap 27 mates to the threaded opening 26. Four threaded inserts 30 are also mounted around the flat surface 18 of the top of the top portion 15 of the container 12. Four metal eyes 31 are threaded to fit into the threaded inserts 30.

Around the sides of the top portion 15 of the container 12 near the bottom portion of the container 16 is a groove 32 extending around the top portion 15. At the part of the bottom portion 16 of the container 12 furthest from the top portion 15 the cone has an opening surrounded by a sleeve 34.

The base 13 has sides 40 forming a box shape having rounded comers and an open top and bottom. A ridge 42 extends around the periphery of the top of the base 13. A notch 44 is formed at the bottom of the base 13. Four depressions 46 are formed in the bottom of the base 13. Within the base are four interior walls 48 extending from the bottom of the base 13 to about midway up the base 13 forming the frustum of a four sided pyramid. The top of the interior walls 48 form an opening 49 to receive the bottom portion 16 of the container 12, and through which part of the bottom portion 16 of the container 12 passes.

The bottom portion 16 of the container 12 is inserted into the base 13, so that the ridge 42 of the base 13 is inserted into the groove 32 of the container 12. The insertion of the ridge 42 into the groove 32 cause the container 12 and base 13 to be held together as one unit.

A ball valve 54 is mechanically connected to the sleeve 34 by a valve connector 55. A plug 67 is inserted in the as ball valve 54.

In operation, the ball valve 54 is closed. Dry product is placed in the container 12 through the opening 26. The cap 27 is then screwed onto the opening 26 to seal the opening 26. As an alternative, the container 10 may be filled from the bottom to provide a maximum fill. In this case, the cap 27 is screwed closed and the container 10 is inverted. The ball valve 54 is opened, and the container is filled through the ball valve 54. The ball valve is then closed, and the valve plug 67 is inserted into the ball valve 54. The valve plug 67 provides an extra measure of security against leakage. A plurality of dry product containers 10 may be stacked on and around each other. The over all box shape allows close packing. By placing the depressions 46 of one dry product container 10 around the molded-in pins 19 of another dry product container 10 the dry product containers 10 may be securely stacked. The dry product containers 10 may then be shipped from the dry product manufacturer to the dry product user.

Figure 4:
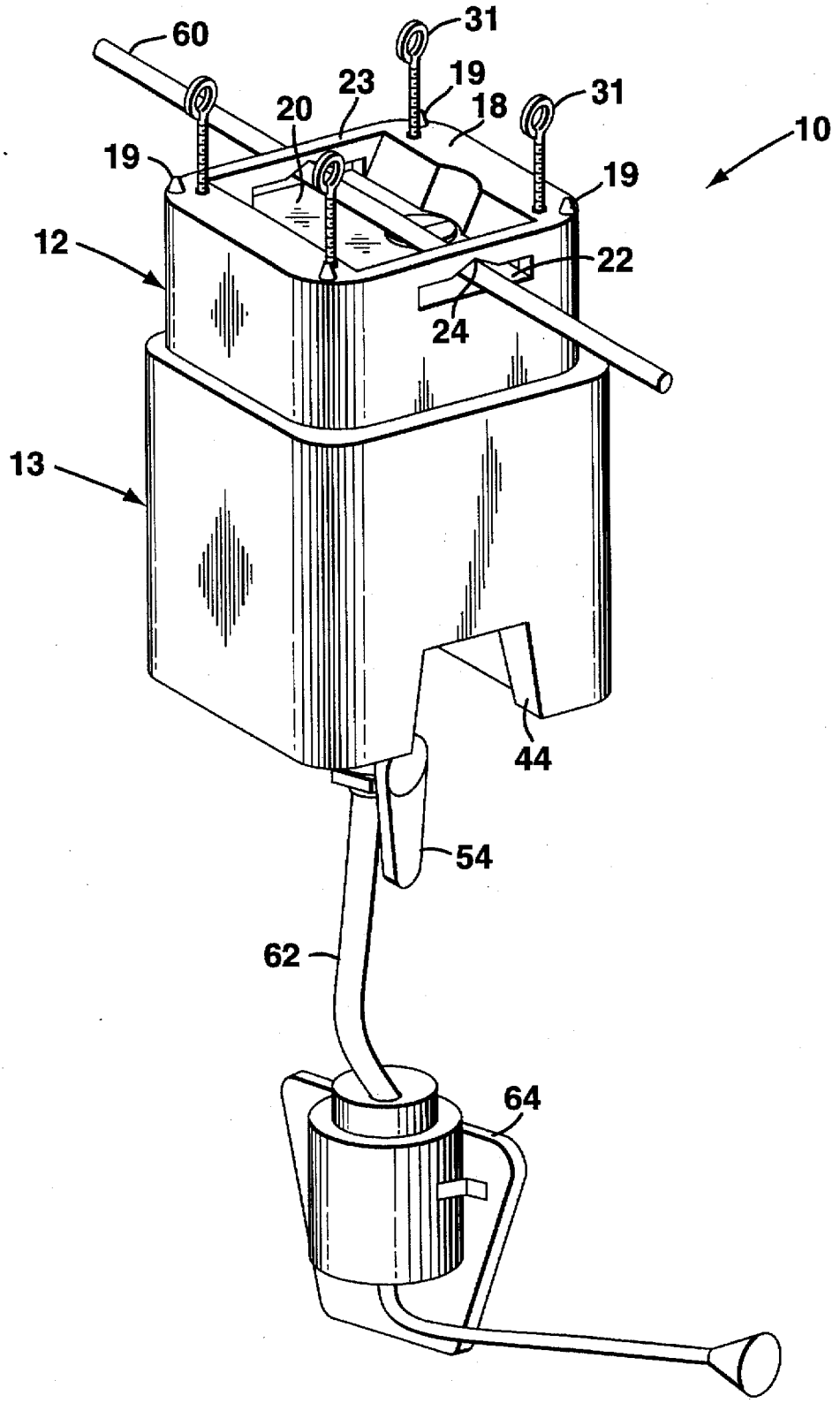

FIG. 4 illustrates how a dry product container 10 may be used in the field. For a dry product such as a pesticide, the dry product is placed into a backpack before dispensing. The handles allow the dry product containers 10 to be transported into the field. A stick 60 may be used to transport the dry product containers 10, by passing the stick through the slots 22 and using the notches 24 to keep the stick 60 in place. The metal eyes 31 can be inserted into the threaded inserts 30 to provide a mounting means to a cable trolley hook by use of rope, strap, chain or other hanging material. Alternatively, a rope strap or chain may be passed through the slots 22 at the notch 24 and attached to a cable trolley hook by an eye at the ends of the cable, strap, or chain. One end of a hose 62 is connected to the ball valve 54 with the other end of the hose placed into a back pack 64. The ball valve 54 is then opened providing dry product through the hose 62 into the back pack. The hose 62 minimizes the amount of dust from the dry product produced outside of the back pack, maximizing the safety to those nearby. The notch 44 allows easy access to the as valve 54.

After the container is emptied, instead of providing waste paper with hazardous residue, which is disposed of, the dry product containers 10 are returned to the manufacturers to be reused. This eliminates the disposal of substances with hazardous residues.

Although the best mode contemplated for carrying out the present invention has been herein shown and described, it will be understood that modification and variation may be made without departing from what is regarded to be the subject matter of the invention.

What is claimed is:

1. A method for providing dry products to product dispensers, comprising the steps of:

joining a container with a base to form a dry product container;

mechanically attaching a valve to the dry product container;

filling the dry product container with dry product;

stacking a plurality of dry product containers upon each other;

transporting the stacked dry product containers; hanging the dry product container;

attaching a first end of a hose to a valve of the dry product container;

placing a second end of the hose in a dispenser;

opening the valve;

closing the valve; and emptying the dry product container;

stacking the dry product container; and returning the dry product container.

* * * * *